US006062640A

United States Patent [19]

Stahl

[11] Patent Number: 6,062,640

[45] Date of Patent: May 16, 2000

[54] TRAY ATTACHMENT FOR CHAIRS

[75] Inventor: Zeev Stahl, Jerusalem, Israel

[73] Assignee: Shilo Technologies, Inc., Jerusalem, Israel

[21] Appl. No.: 09/226,993

[22] Filed: Jan. 7, 1999

[30] Foreign Application Priority Data

Jan. 9, 1998 [IL] Israel ..... 122887
Jul. 29, 1998 [IL] Israel ..... 125568

[51] Int. Cl.[7] ..... A47B 39/00

[52] U.S. Cl. ..... 297/135; 297/188.18

[58] Field of Search ..... 297/135, 153, 297/188.18, 188.14, 188.01, 188.21; 108/157.11; 248/229.13, 231.51, 316.5

[56] References Cited

U.S. PATENT DOCUMENTS 1,201,166 10/1916 Funsch .
1,872,491 8/1932 Noetzel .
2,797,973 7/1957 Culpepper .
4,798,413 1/1989 Capelli ..... 297/194
5,038,451 8/1991 Smith ..... 29/434
5,344,115 9/1994 Mayne et al. ..... 284/514
5,533,782 7/1996 Goldman .
5,649,737 7/1997 Behnke ..... 297/170

FOREIGN PATENT DOCUMENTS 322029 of 1901 Switzerland ..... 297/135
301390 9/1954 Switzerland ..... 297/135

*Primary Examiner*—Milton Nelson, Jr.
*Attorney, Agent, or Firm*—Flehr Hohbach Test Albritton & Herbert LLP

[57] ABSTRACT

A tray attachment for a chair with at least one armrest (AR) of a substantially inverted-U or inverted L-shaped cross-section having a top portion (TP) and at least one lateral flange portion (FP), the attachment including a tray member (2) having an upper side and an underside, at least one arm (10), fixedly attached to or integral with the tray member (2) and extending in a direction substantially perpendicular to the plane of the tray member, the free end of the arm being configured to form a hinge (28,30); a clamping member (14) including a clamping arm (34) joined to a clamping jaw (36) and being articulated to the hinge, and a detent (18) mounted on a post (16) positioned on the underside of the tray member in a spaced-apart relationship with the arm.

25 Claims, 6 Drawing Sheets

TRAY ATTACHMENT FOR CHAIRS

FIELD OF THE INVENTION

The present invention relates to a tray attachment for chairs having armrests.

BACKGROUND OF THE INVENTION

Tray attachments for chairs, especially garden and patio chairs, are known. These attachments, however, require the original arm or arms to be modified by the provision of keyhole-type slots (U.S. Pat. No. 5,038,451 to Smith), which is beyond the skill and equipment of an ordinary person and makes the attachment non-retrofittable, or (U.S. Pat. No. 4,798,413 to Capelli) by drilling holes into the armrest or providing a specially modified armrest. U.S. Pat. No. 5,649,737 to Behnke proposes either the use of cloth-peg type fasteners or, again, the provision of holes or keyhole-type slots in the chair arms. U.S. Pat. No. 5,344,115 to Mayne, while not requiring modification of the original armrest, proposes the use of quite intricate, heavy, spring-loaded and thumbscrew-operated clamps that are not only expensive, but also certain to mar the polished surfaces of plastic patio or garden chairs.

SUMMARY OF THE INVENTION

It is therefore one of the objects of the present invention to provide a tray attachment that does not require modification of chairs or their armrests, is simple, and is mounted and dismounted in seconds.

According to the invention, the above object is achieved by providing a tray attachment for a chair with at least one armrest of a substantially inverted-U or inverted L-shaped cross-section having a top portion and at least one lateral flange portion, said attachment comprising a tray member having an upper side and an underside; at least one arm, fixedly attached to or integral with said tray member and extending in a direction substantially perpendicular to the plane of said tray member, the free end of said arm being configured to form a member of hinge means; a clamping member comprising a clamping arm joined to a clamping jaw and being articulated to said member of said hinge means, and detent means mounted on a post positioned on the underside of said tray member in a spaced-apart relationship with said arm.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DETAILED DESCRIPTION OF PREFERRED EMBODIMENTS

Figure 1:
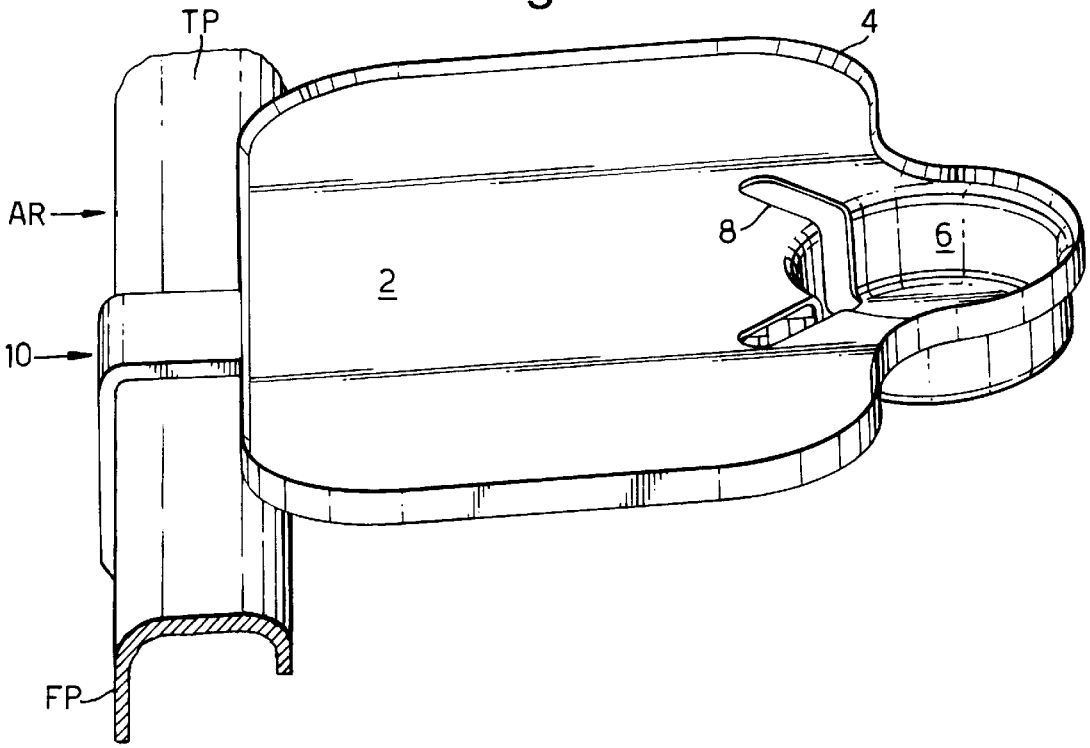
FIG. 1 is a perspective view of the tray attachment according to the invention, as seen from above.

Referring now to the drawings, there is seen in FIG. 1 a tray 2, advantageously diecast from a suitable plastic material such as PP or the like, and comprising a peripheral rim 4, a recess 6 for holding a cup and slots 8 for accommodating cup handles. Other tray configurations are obviously also possible: rimless; without recess 6 (for writing purposes); of different shapes; without slots 8; with recess 6 of different shapes, etc.

Figure 2:
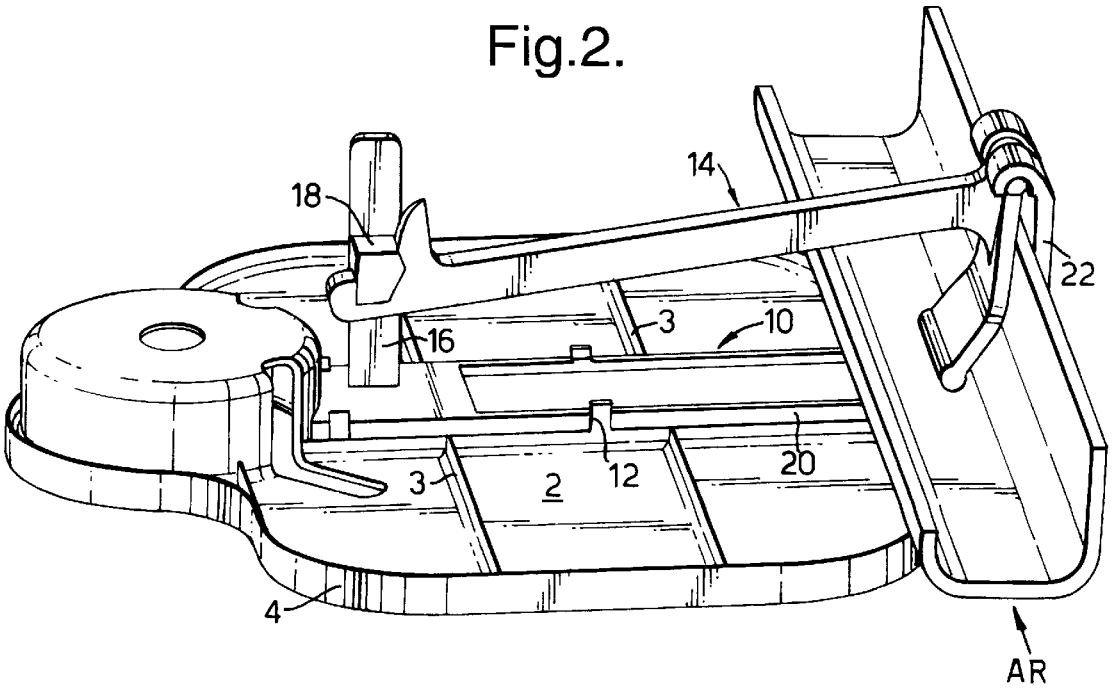
FIG. 2 is a perspective view of the fully mounted tray attachment, seen from below.
Figure 3:
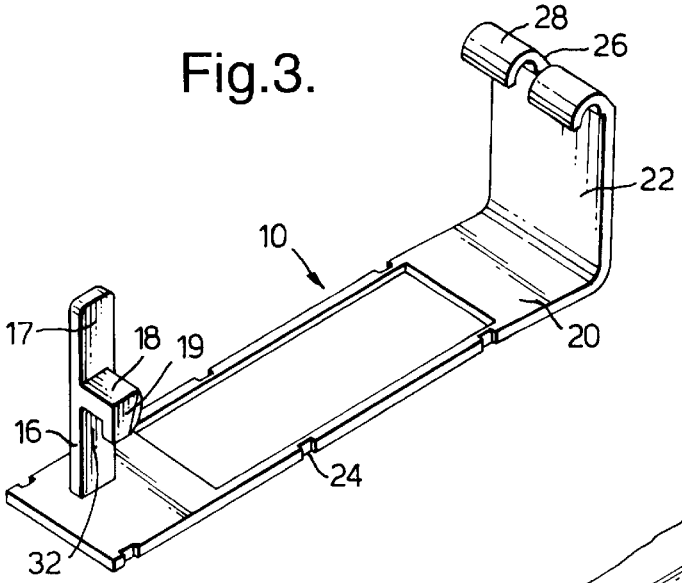
FIG. 3 is a perspective view of the bracket member of the attachment.

Also seen is a bracket member 10, shown to better advantage in FIGS. 2 and 3. Equally seen are a section of an armrest AR and the top portion TP thereof, as well as a flange portion FP.

Figure 4:
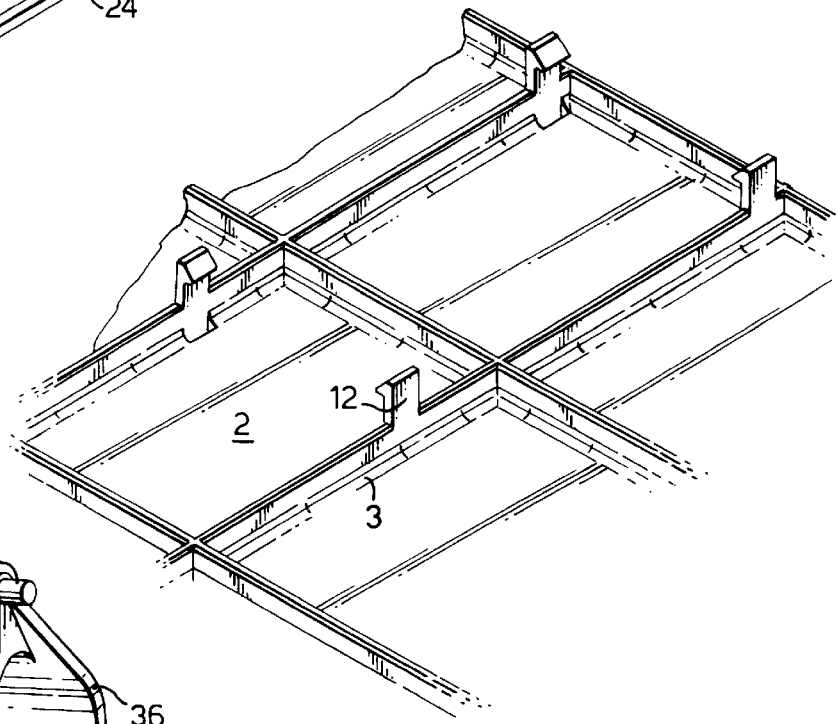
FIG. 4 is a partial perspective view of the underside of the tray member, showing the fingers that retain the bracket member.

FIG. 2 shows the underside of the tray attachment, including a portion of armrest AR to which the tray has been clamped. Shown are tray 2, complete with reinforcing ribs 3, and bracket member 10 (see FIG. 3) which is fixedly attached to tray 2 by means of fingers 12, shown on an enlarged scale in FIG. 4. Also shown are a clamping member 14 and a post 16 carrying a detent 18.

Bracket member 10, shown in FIG. 3, is seen to be substantially L-shaped, having a longer limb 20 and a shorter limb 22. Limb 20 is attached to tray 2 with the aid of fingers 12 (shown to better advantage in FIG. 4) which snap into recesses 24 (FIG. 3), thereby defining the position of bracket member 10 relative to tray 2.

Figure 5:
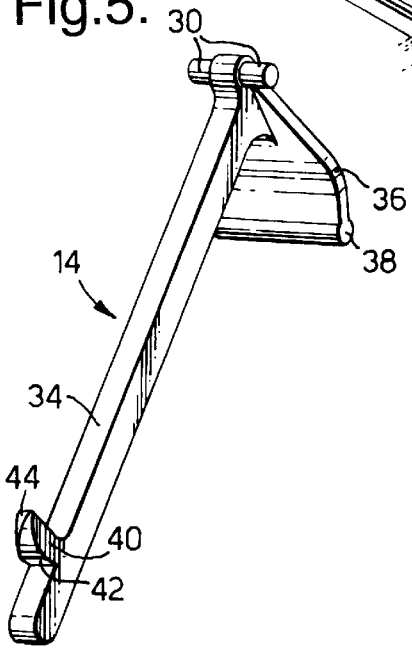
FIG. 5 is a perspective view of the clamping member of the attachment.

The upper end of limb 22 is seen to be curled and, divided by a slot 26, forms the female members 28 of a hinge arrangement in which the male members are constituted by pivots 30 that are parts of clamping member 14, illustrated in FIG. 5. Since the hinge arrangement is advantageously of the snap-in type, the angle subtended by female members 28 is slightly more than 180°. It is, however, also possible to use a conventional hinge design, in which case the female members would surround the male member over 360°, and the latter would be a single pin applied upon assembling clamping member 14 and bracket member 10.

Further seen is a post 16 fixedly attached to or, advantageously, integral with, bracket member 10, and located near the free end of limb 20. Post 16 carries detent 18 in the form of a block having a slot-like recess 32 of a width matching the thickness of clamping arm 34 (FIG. 5). Detent 18 is further provided with a suitably configured chamfer 19 which, in cooperation with a chamfer 44 on nose 40 of clamping arm 34 (FIG. 5) facilitates the engagement of clamping arm 34 when the latter is pressed in order to attach tray 2 to armrest AR.

Optionally, post 16 is extended beyond detent 18, as shown. Flexing post 16 by applying a force to extension 17 after clamping arm 34 has been pushed towards bracket member 10 far enough for clamping arm 34 to escape recess 32, makes mounting of the tray attachment easier.

Further seen in FIG. 5 is clamping member 14, which comprises two main components: clamping arm 34 and clamping jaw 36. At the end of clamping arm 34, where the latter is joined to clamping jaw 36, there are located two pivots 30, one on each side. Pivots 30 are the male members of the hinge arrangement by which clamping member 14 is articulated to bracket member limb 22.

Figure 7:
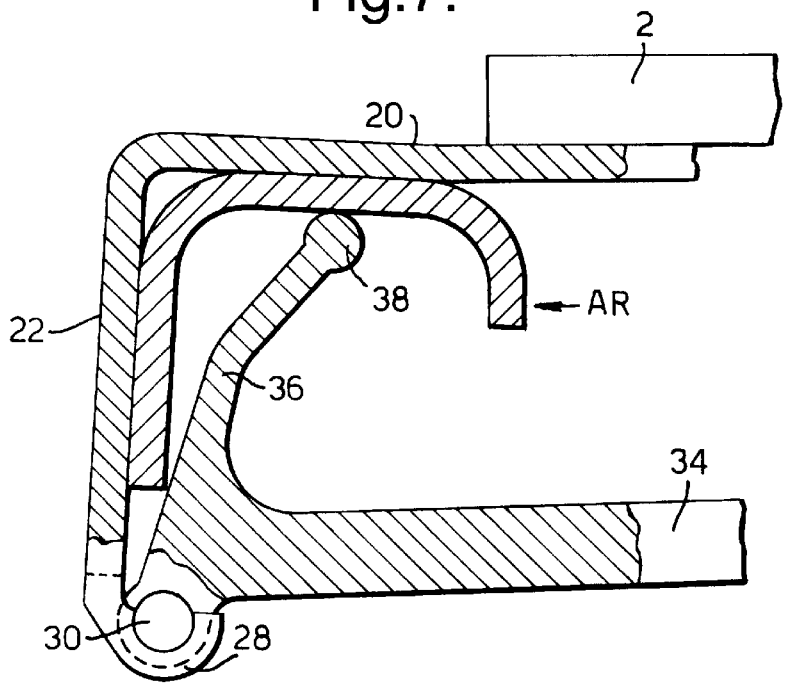
FIG. 7 is a partial, cross-sectional view, showing a subsequent stage in the mounting of the tray attachment.

Clamping jaw 36 advantageously has a beaded edge 38, by means of which force is applied against armrest AR, thereby clamping the latter between limb 20 and edge 38, as is clearly seen in FIG. 7.

Also seen in FIG. 5 is a nose-like projection 40 located near the free end of clamping arm 34. While lower portion 42 serves to define the position of clamping arm 34 relative to detent 18 (see FIG. 2), chamfer 44 on the upper portion of projection 40, as already mentioned, cooperates with chamfer 19 (FIG. 3) to facilitate engagement of clamping arm 34 in recess 32.

Figure 6:
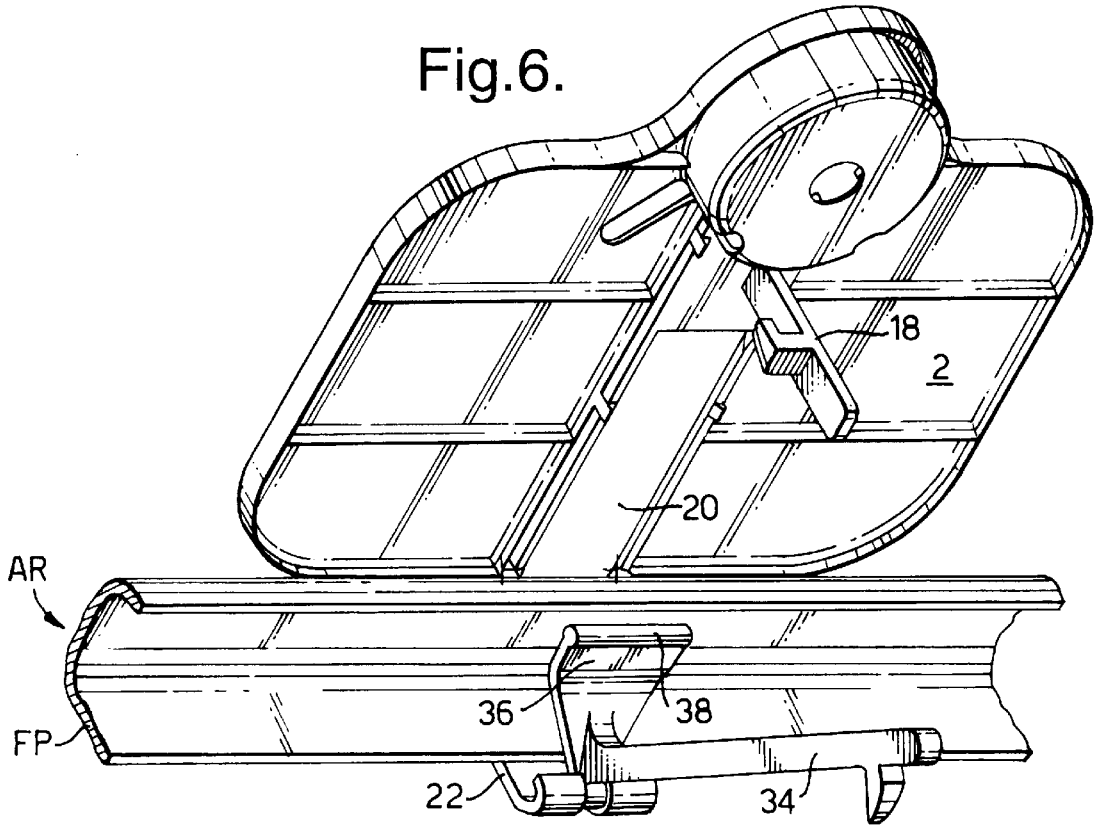
FIG. 6 is a perspective view, seen from below, illustrating the first stage in the mounting of the tray attachment according to the invention.

FIG. 6 illustrates the first stage of the mounting of the tray attachment. The tray attachment, with clamping arm 34 in the open position as shown, is slipped over armrest AR in such a way that flange portion FP of armrest AR is located between clamping jaw 36 and limb 22. At this stage, edge 38 of jaw 36 does not yet touch the inside surface of armrest AR. Now clamping arm 34 is lifted up towards tray 2, using one hand, until edge 38 touches the inside of armrest AR, a situation depicted in FIG. 7. Further pressure from below, countered by pressure on tray 2 from above, using the other hand, will flex clamping arm 34 and, to some degree, also clamping jaw 36, until clamping arm 34 hits detent 18, at which point additional pressure and a slight lateral deflection of clamping arm 34 will guide clamping arm 34 with the help of chamfers 19 (FIG. 3) and 44 (FIG. 5) into recess 32. It is the elastic deformation caused by flexure of clamping arm 14 and clamping jaw 36 that generates the resilient force which produces the clamping effect. This effect obviously prevails as long as clamping arm 34 is held in detent recess 32.

Figure 8:
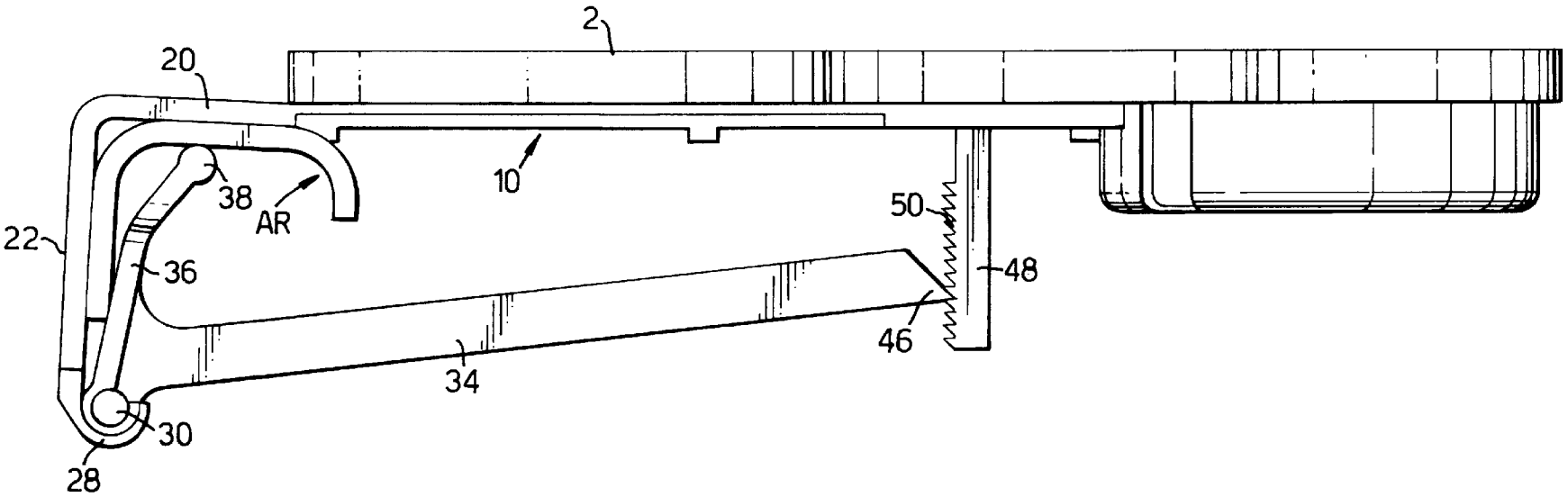
FIG. 8 is a side view of another embodiment of a tray attachment, showing a pawl-and-ratchet type detent design.

A variant of the tray attachment described in FIGS. 1 to 7 is represented in FIG. 8, the difference residing in the detent principle which, here, takes the form of a pawl-and-ratchet type detent, in which the free end of clamping arm 34 is configured as pawl 46 and post 48 serves as ratchet with teeth 50. Ideally, the row of teeth 50 should be curved, with the center of curvature located at the center of pivots 30.

Figure 9:
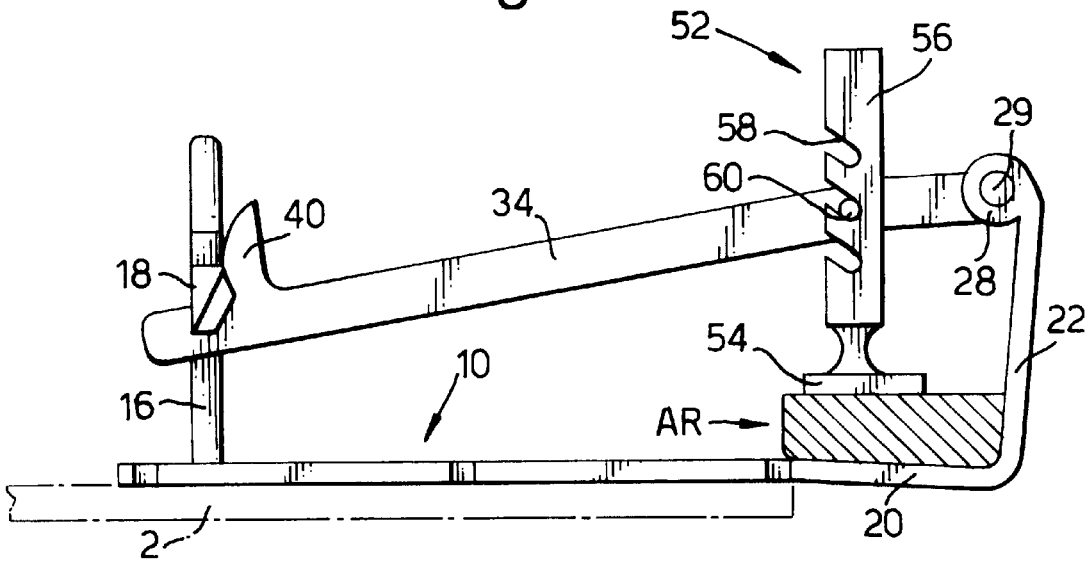
FIG. 9 is a side view of the bracket member and the clamping arm of another embodiment of the invention, as seen in the upside-down position.
Figure 10:
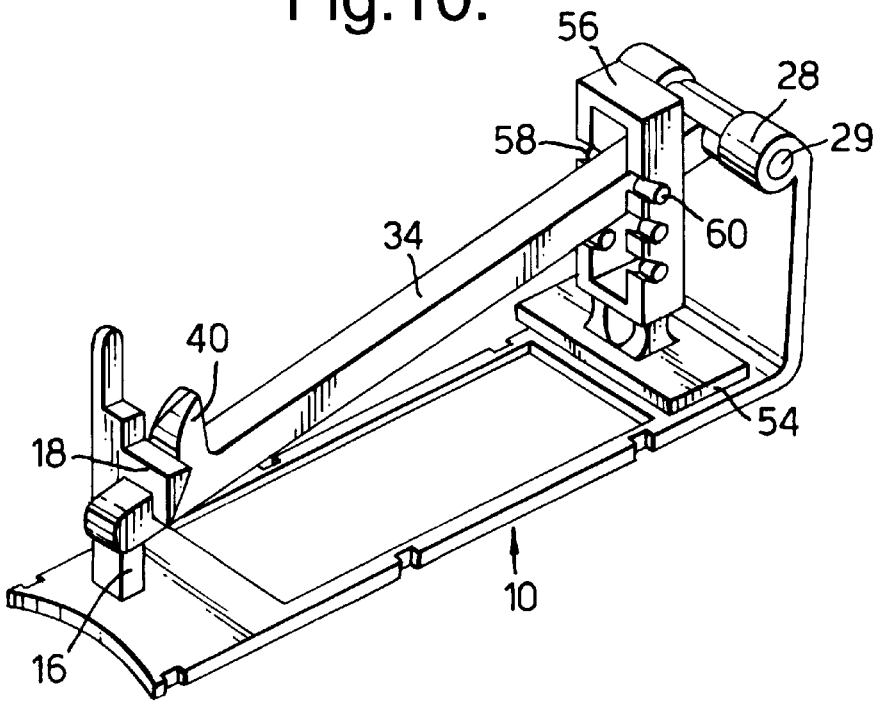
FIG. 10 is a perspective view of the bracket member and clamping arm of FIG. 9, and FIGS. 11 and 12 are side views of the bracket member and clamping member of a still further embodiment of the invention, showing two stages of mounting of the tray.

While the embodiments of FIGS. 1–7 and 8 are designed for use with chairs with an armrest of an inverted-U- or inverted-L-shaped cross-section, the embodiment illustrated in FIGS. 9 and 10 is intended for use with chairs having an armrest of a substantially rectangular cross-section.

FIG. 9 shows bracket member 10 which is substantially the same as that of the previous embodiment. So is clamping arm 34, except that it lacks clamping jaw 36. The hinge arrangement at the end of short bracket limb 20 is of the previously-mentioned conventional design in which female member 28 surrounds its male counterpart over 360°. The latter is a separate pin 29 applied upon assembling clamping arm 34 and bracket member 10. However, the snap-in arrangement discussed in conjunction with FIG. 3 is also possible.

Post 16, detent member 18 and nose 40 of the embodiment of FIG. 9 are substantially the same as described previously in conjunction with FIGS. 1–7. A new feature is a clamping ram 52, seen in FIG. 9 to apply pressure to the armrest AR for attachment of tray 2. Ram 52 consists of a ram head 54 and a ram body 56. The latter, as can be seen in the perspective view of FIG. 10, is framelike and is provided with pairs of slots 58 slanting in the direction of ram head 54, into which slots fits a pin 60. The latter can be integrally molded with arm 34 or can be separate. These pairs of slots 58, three in this particular embodiment, permit the use of the ray with chairs having armrests of different thickness. As with the previous embodiments, the clamping effect is produced by the reaction to the elastic deformation undergone by clamping arm 34 when forced to engage detent member 18.

Figure 11:
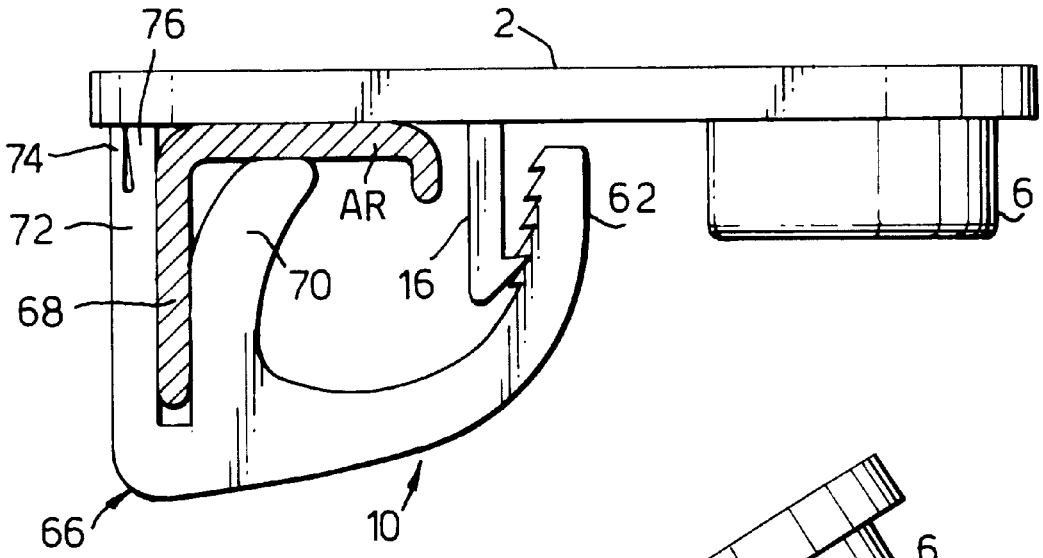
Figure 12:
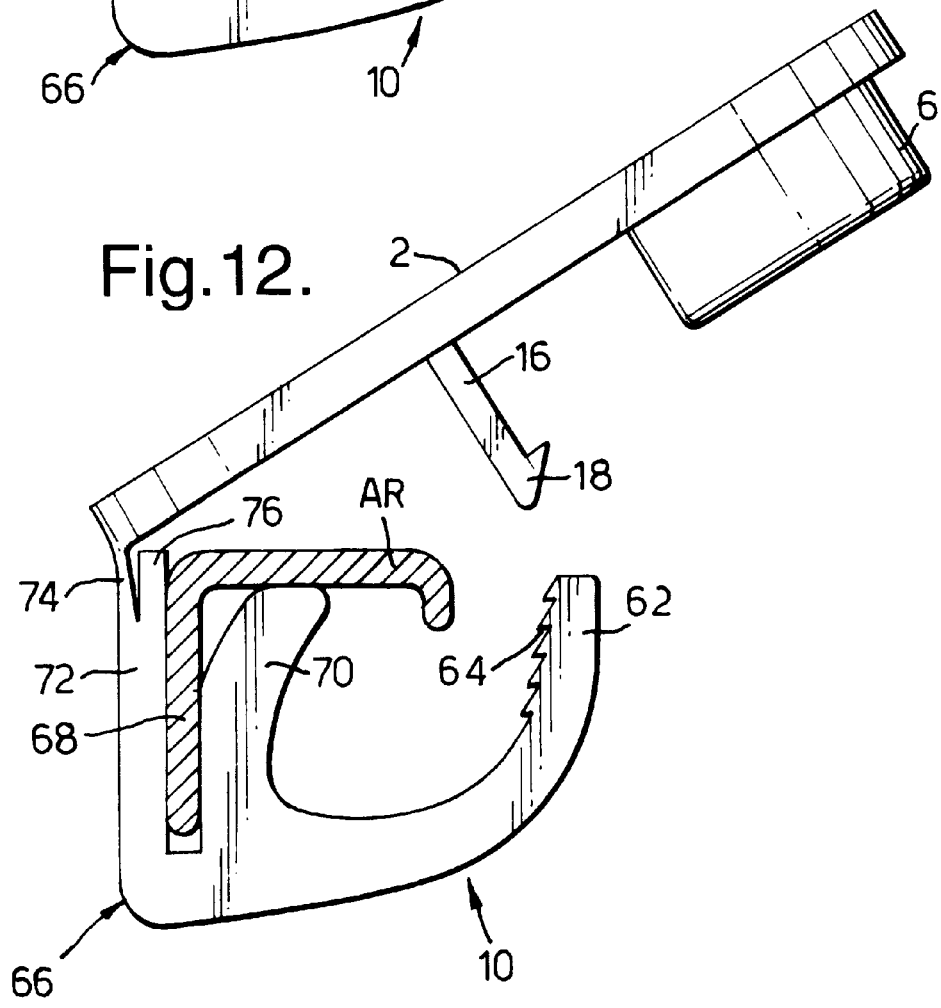

While in the embodiments disclosed, tray 2 and bracket member 10 are separate components with the latter fixedly attached to the former, it is also feasible to diecast these two components as an integral whole, as shown in FIGS. 11 and 12. Seen is the armrest AR, the tray 2 with a cup-holding recess 6 and a post 16 carrying a detent 18 attached to the underside of the tray 2. The bracket 10 is formed with a free end portion 62 having a row of teeth 64 engageable with the detent 18, and a second slotted portion 16 sized for retaining the downwardly extending portion 68 of the arm AR. One limb 70 of the portion 66 serves as an abutment for the armrest AR, while the free edge of the other limb 72 is advantageously split into a first edge portion 74 and a second edge portion 76. The edge portion 74 is integrally connected to the tray 10, constituting a hinge.

It should, however, be borne in mind that people might want to mount the tray attachment either on their left or their right. This poses no problem, as long as the tray is symmetrical relative to the bracket-member axis. If, however, the tray is not symmetrical relative to that axis, as is likely to be the case with more elaborately designed tray shapes or, e.g., writing surfaces, switching from one to the other armrest is only possible if the bracket member can be separated from the tray and reattached after turning it 180°.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A tray attachment for a chair with at least one armrest of one of substantially inverted-U and inverted L-shaped cross-section having a top portion and at least one lateral flange portion, said attachment comprising:

a tray member having an upper side and an underside;

at least one arm, fixedly connected with said tray member and extending in a direction substantially perpendicular to the plane of said tray member, a free end of said arm being configured to form a member of a hinge means;

a clamping member comprising a clamping arm joined to a clamping jaw and being articulated to said member of said hinge means, and detent means mounted on a post positioned on the underside of said tray member in a spaced-apart relationship with said arm.

2. The tray attachment as claimed in claim 1 wherein said detent means is a slotted recess in a block, said recess being of a width sufficient to accommodate the thickness of said clamping arm.

3. The tray attachment as claimed in claim 1 wherein said detent means is a ratchet.

4. The tray attachment as claimed in claim 3, wherein a free end of said clamping member is configured as a pawl, interacting with said ratchet.

5. The tray attachment as claimed in claim 1, further comprising a chamfered projection near a free end of said clamping arm, designed to define the position of said clamping arm relative to said detent means and to assist in the mounting and dismounting of said attachment.

6. The tray attachment as claimed in claim 1 wherein said clamping member is articulated to said member of said hinge means by two coaxial pivots projecting from and straddling the portion where said clamping arm and said clamping jaw are joined.

7. The tray attachment as claimed in claim 6, wherein said member of said hinge means is configured to constitute female members of said hinge means, male members thereof being formed by said pivots.

8. The tray attachment as claimed in claim 7, wherein said hinge means is a snap-in hinge means, with said female members surrounding said male members over an angle slightly more than 180°.

9. The tray attachment as claimed in claim 1, wherein said arm is a component part of an L-shaped bracket, the other part of which is substantially parallel to the plane of said tray member.

10. The tray attachment as claimed in claim 9 wherein said clamping member is articulated to said member of said hinge means by two coaxial pivots projecting from and straddling the portion where said clamping arm and said clamping jaw are joined.

11. The tray attachment as claimed in claim 10, wherein said member of said hinge means is configured to constitute female members of said hinge means, male members thereof being formed by said pivots.

12. The tray attachment as claimed in claim 11, wherein said hinge means is a snap-in hinge means, with said female members surrounding said male members over an angle slightly more than 180°.

13. A tray attachment for a chair with at least one armrest of a substantially rectangular cross-section having a top portion, a bottom portion and lateral portions, said attachment comprising:

a tray member having an upper side and an underside;

at least one L-shaped bracket member having a first limb and a second limb, said bracket member being fixedly attached to the underside of said tray member and being adapted to rest with said first limb on said top portion and with said second limb against one of the lateral portions of said armrest, the free end of said second limb being configured to form hinge means;

a clamping ram selectively articulatable in at least one optional position to a clamping arm;

detent means mounted on a post near the end of said first limb of said bracket member;

whereby, with said tray member and bracket member having been mounted on said armrest, pressing said clamping arm towards said bracket member will apply said clamping ram against the underside of said armrest and cause said clamping arm to engage, and be retained by, said detent means.

14. The tray attachment as claimed in claim 13, wherein said hinge means consists of a female member surrounding a male counterpart over 360°.

15. The tray attachment as claimed in claim 13 further comprising a chamfered projection near a free end of said clamping arm, designed to define the position of said clamping arm relative to said detent means and to assist in the mounting and dismounting of said attachment.

16. The tray attachment as claimed in claim 13 wherein said detent means is a slotted recess in a block, said recess being of a width sufficient to accommodate the thickness of said clamping arm.

17. The tray attachment as claimed in claim 13, wherein said clamping ram comprises a ram head and a ram body.

18. The tray attachment as claimed in claim 17, wherein said ram body is a frame and is provided with at least one pair of slots slanting in the direction of said ram head.

19. A tray attachment for a chair with at least one armrest of one of substantially inverted-U and inverted-L-shaped cross-section having a top portion and at least one lateral flange portion, said attachment comprising:

at least one substantially L-shaped bracket member having a first limb and a second limb, said bracket member being fixedly to the underside of a tray member and being adapted to rest with said first limb on said top portion and, with said second limb, to make contact with said lateral flange portion, the free end of said second limb being configured to form a member of a hinge means;

a clamping member comprising a clamping arm jointed to a clamping jaw, and being articulated to said member of said hinge means, the clamping jaw having a free end, and detent means mounted on a post near the end of the first limb of said bracket member;

wherein, with said tray member and bracket member having been mounted on said armrest, pressing said clamping arm towards said bracket member will cause the free end of said clamping jaw to pull said bracket member against said armrest and to cause said clamping arm to engage, and be retained by, said detent means.

20. The tray attachment as claimed in claim 19 wherein said detent means is a slotted recess in a block, said recess being of a width sufficient to accommodate the thickness of said clamping arm.

21. The tray attachment as claimed in claim 19 further comprising a chamfered projection near a free end of said clamping arm, designed to define the position of said clamping arm relative to said detent means and to assist in the mounting and dismounting of said attachment.

22. The tray attachment as claimed in claim 19 wherein said detent means is a ratchet.

23. The tray attachment as claimed in claim 22, wherein the free end of said clamping member is configured as a pawl, interacting with said ratchet.

24. A tray attachment for a chair with at least one armrest of one of substantially inverted-U and -L-shaped cross-section having a top portion and at least one lateral flange portion, said attachment comprising:

a tray member having an upper side and an underside and a bracket member articulated thereto, wherein:

said bracket member is substantially U-shaped, having a first portion and a second portion;

said first portion is engageable with an element extending from the underside of said tray member;

said second portion has a first limb and a second, spaced-apart limb for accommodation therein of a lateral portion of said armrest, and said first limb serves as an abutment for the armrest and an edge portion of said second limb is hingedly articulated to said tray member.

25. The tray attachment as claimed in claim 24, wherein said bracket member is made integrally with said tray member.

* * * * *